US006119648A

United States Patent [19]

Araki

[11] Patent Number: 6,119,648

[45] Date of Patent: Sep. 19, 2000

[54] FOUR-STROKE CYCLE INTERNAL COMBUSTION ENGINE

[75] Inventor: Tsuneo Araki, Tokyo, Japan

[73] Assignee: Kioritz Corporation, Tokyo, Japan

[21] Appl. No.: 08/921,590

[22] Filed: Sep. 2, 1997

[30] Foreign Application Priority Data

Sep. 5, 1996 [JP] Japan ..... 8-235498

[51] Int. Cl.[7] ..... F01M 1/00

[52] U.S. Cl. ..... 123/196 R; 123/196 W

[58] Field of Search ..... 123/196 R, 196 W

[56] References Cited

U.S. PATENT DOCUMENTS 1,517,227 11/1924 Brockway .

4,628,878 12/1986 Nakano et al . .

5,947,075 9/1999 Ryu et al. ..... 123/196 W

*Primary Examiner*—John Kwon

*Attorney, Agent, or Firm*—Jacobson, Price, Holman & Stern, PLLC

[57] ABSTRACT

A four-stroke cycle internal combustion engine, having a crankcase. A connecting rod is provided in the crankcase. An inner wall extends to surround all sides and the bottom of the connecting rod. An outer wall extends to surround the inner wall. The upper ends of the outer wall are connected to the inner wall to form an oil reservoir under the crankcase and oil recess areas on both sides of the crankcase therebetween. An oil dipper for splattering the oil contained in the oil reservoir is provided at the big end of the connecting rod. A slit is formed at a bottom of the inner wall for allowing the oil dipper to go though to make contact with the oil.

4 Claims, 5 Drawing Sheets

FOUR-STROKE CYCLE INTERNAL COMBUSTION ENGINE

BACKGROUND OF THE INVENTION

The present invention relates to a four-stroke cycle internal combustion engine and more particularly to a four-stroke cycle internal combustion engine especially suitable to use for driving a portable working machine but not limited thereto.

DESCRIPTION OF THE PRIOR ART

A portable working machine such as a trimmer driven by an electronic spark ignition type internal combustion engine has been known. For example, in the case of a trimmer, a driving shaft is connected to a crankshaft of an internal combustion engine via a centrifugal clutch tberebetween and a cutter is mounted at an end of the driving shaft via gears. An operator holds the trimmer by hand and cuts weeds on the ground or trims leaves of trees overhead by the cutter rotably driven by the internal combustion engine. Therefore, the internal combustion engine of the portable working machine can not only assume a vertical orientation but can also assume a horizontal or upside-down orientation.

Conventionally, to drive the portable working machine, a two-stoke cycle internal combustion engine has been used to reduce the weight of the apparatus. In the two stroke cycle internal combustion engine, a crankshaft and a piston are lubricated by oil mixed with an air-fuel mixture and the oil is exhausted with combusted gas to the outside of the engine, thus creating an air pollution problem. Recently, because of the need for environmental protection, there is a desire to provide an internal combustion engine that presents less of an air pollution problem. In order to satisfy such demand, it is preferable to utilize a four-stroke cycle internal combustion engine which creates less air pollution.

However, the convention four-stoke cycle internal combustion engine has an oil pan provided under a connecting rod and oil in the oil pan is splatterd or splashed by, for example, an oil dipper provided at a big end of the connecting rod to lubricate parts of the engine. Therefore, if the engine assumes a horizontal or upside-down orientation during operation as stated above, a large amount of oil in the oil pan flows into the cylinder area of the engine causing the piston to be emersed therein and a breather to be blocked thereby.

SUMMARY OF THE INVENTION

Therefore, the object of the present invention is to provide a four-stoke cycle internal combustion engine which can be used for a working machine that may assume an inclined, horizontal or upside-down orientation during operation.

The above and other objects of the present invention can be accomplished by a four-stroke cycle internal combustion engine, made up of a crankcase and a connecting rod provided in the crankcase. An inner wall extends to surround all sides and bottom of the connecting rod. An outer wall extends to surround the inner wall and upper ends thereof being connected to the inner wall to form an oil reservoir under the crankcase and oil recess area on both sides of the crankcase therebetween. An oil dipper for splattering the oil is contained in the oil reservoir and is provided at the big end of the connecting rod, and a slit is formed at the bottom of the inner wall for allowing the oil dipper to go through to make contact within the oil.

In a preferred aspect of the present invention, the volume of the oil recess area is of a size capable of containing the oil without the oil flowing into the crankcase through the slit when the engine is moved from a vertical orientation toward an upside-down orientation.

In a further preferred aspect of the present invention, the oil dipper extends substantially straight along a center axis of the connecting rod, and the slit is formed substantially symmetrical with respect to the center axis of the connecting rod.

The above and other objects and features of the present invention will become apparent from the following description made with reference to the accompanying drawings.

DESCRIPTION OF THE PREFERRED EMBODIMENTS

A four-stroke cycle internal combustion engine in accordance with a preferred embodiment of the present invention shall be explained with reference to the drawings attached hereto.

Figure 1:
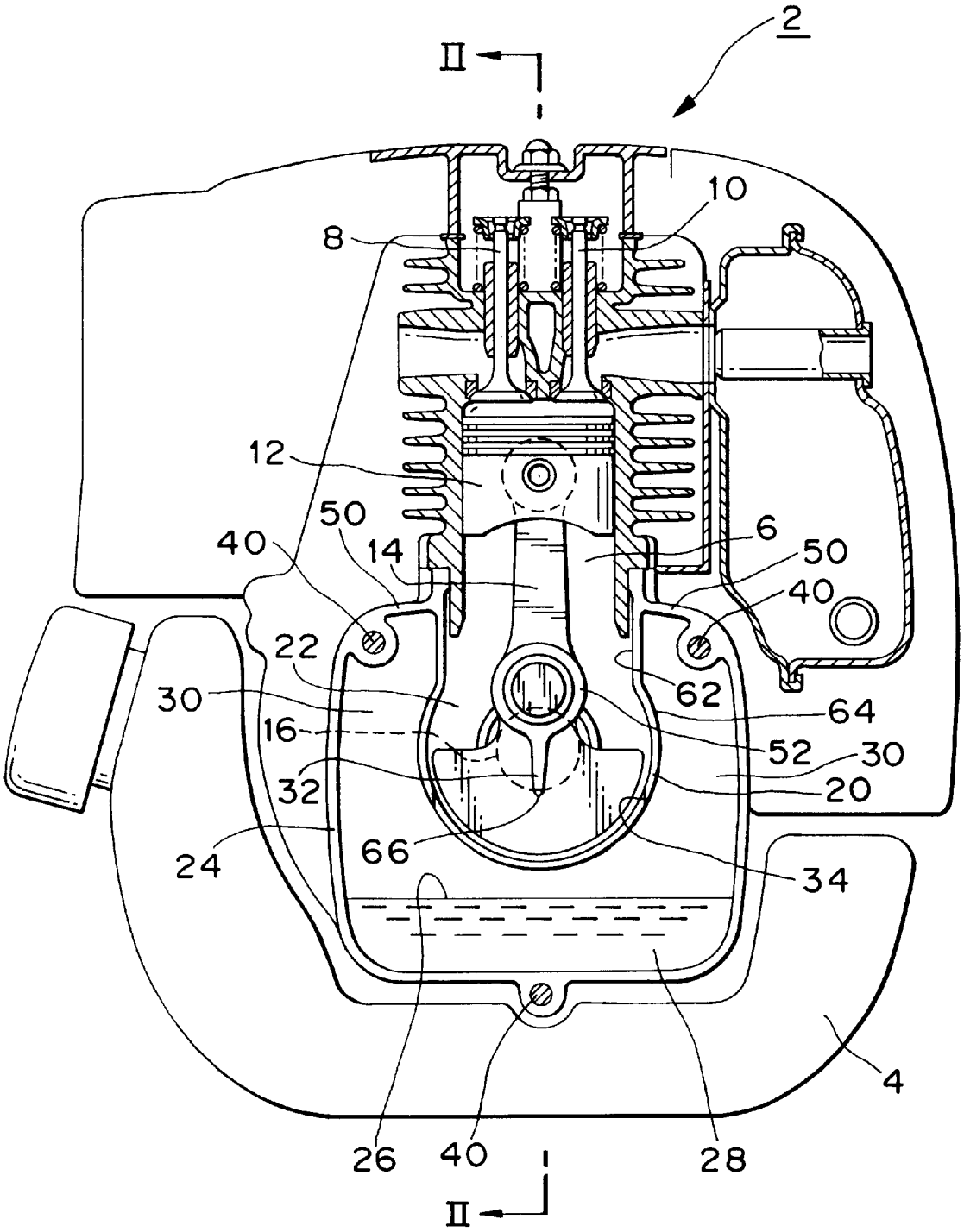
FIG. 1 is a schematic cross-sectional view showing a four-stroke cycle internal combustion engine in accordance with a preferred embodiment of the present invention.
Figure 2:
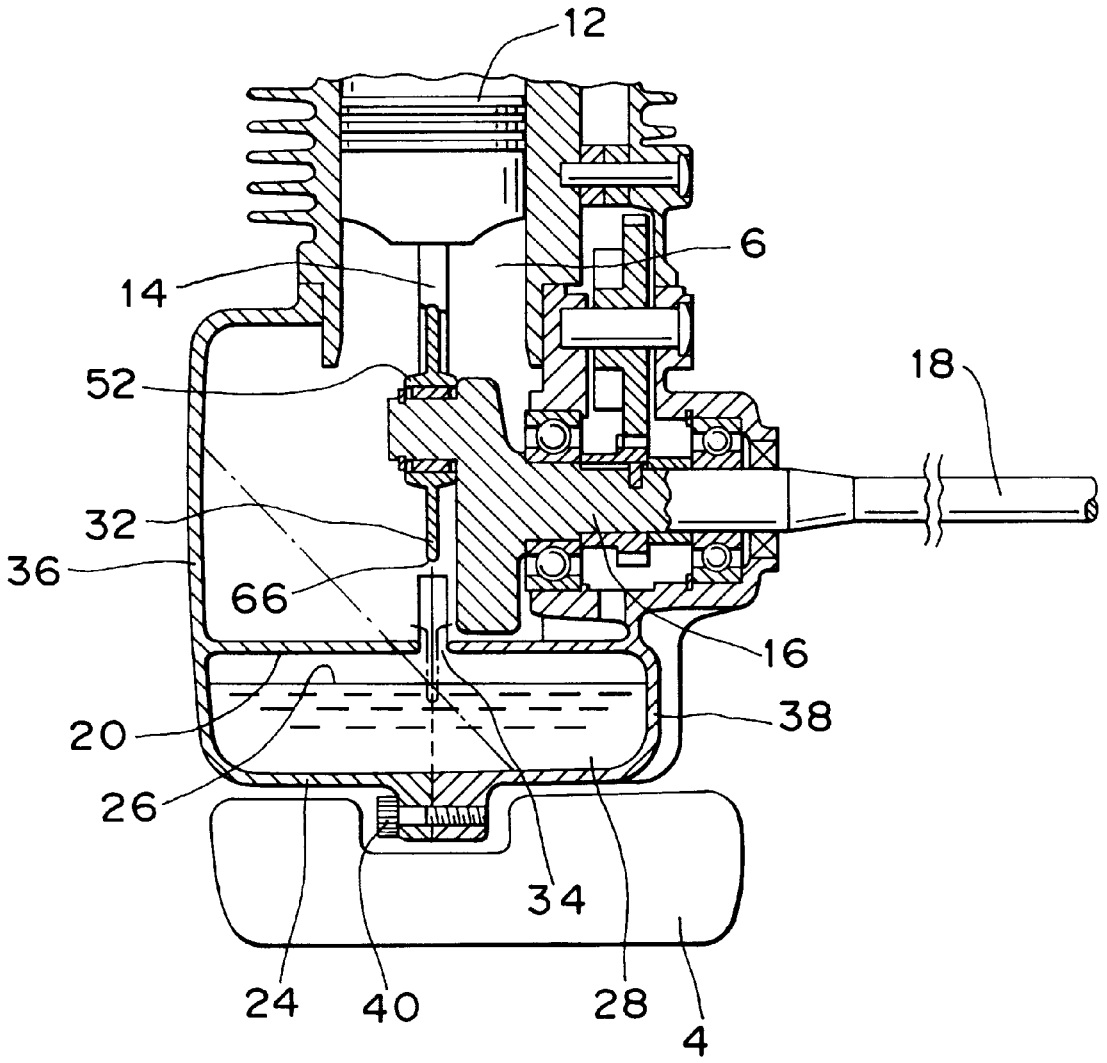
FIG. 2 is a cross-sectional view of the four-stoke cycle internal combustion engine taken along line II—II in FIG. 1.

As illustrated in FIGS. 1 and 2, a four-stroke cycle internal combustion engine 2 has one cylinder and is air cooled. The structure of the engine 2 is basically the same as in conventional ones. That is, gasoline is fed to a cylinder 6 from a fuel tank 4 provided under the engine 2. An intake valve 8 and an exhaust valve 10 located above the cylinder 6 are opened and closed at predetermined intervals and the piston 12 moves up and down in a reciprocating motioning in cylinder 6 oriented in a vertical direction. A crankshaft 16 is rotated by a connecting rod 14 joined to the piston 12 and a driving shaft 18 (see FIG. 2) connected to the crankshaft 16 is driven thereby. A cutter (not shown) provided at an end of the driving shaft 18 is rotatably driven thereby via a centrifugal clutch (not shown).

As viewed in FIG. 1 an inner wall 20 surrounds the connecting rod 14 on the left, right, and under sides. The inner wall 20 forms a crankcase 22 on the inner side 62 thereof. Further, an outer wall 24 surrounds the outer side 64 of the inner wall 20 at a distance therefrom to form a space therebetween. The upper ends 50 of the outer wall 24 are integrally connected to the inner wall 20. They define an oil pan or oil reservoir 28 under the crankcase 22 which contains oil 26 for lubricating parts of the engine. Further, they also define oil recess areas 30, 30 on the left and right sides of the crank case 22. The oil recess area 30, 30 are capable of containing the oil 26 coming from the oil pan 28 when the engine 2 is inclined from a vertical orientation to an inclined, horizontal or upside-down orientation.

A big end 52 of the connecting rod 14 is provided with an elongated oil dipper 32 projecting therefrom straight along an elongated center axis of the connection rod 14. The oil dipper 32 is for splattering or splashing the oil 26 in the oil pan 28 for lubricating parts of the engine. An elongated slit 34 is formed at the bottom of the inner wall 20 to allow the oil dipper 32 to go through as the connecting rod 14 moves in a reciprocating motion in a vertical direction. The width and length of the slit 34 are dimensioned to be as small as possible to enable a predetermined amount of oil to be splattered upward toward the crankcase 22 and the cylinder 6. Further, the oil dipper 32 extends straight along the elongated center axis of the connecting rod 14 and the slit 34 is formed in symmetry with respect to the elongated center axis of the connecting rod 14 to correspond to a symmetrical locus of its motion.

As will be noted from FIG. 2, the inner wall 20 and the outer wall 24 comprise a first half portion 36 and a second half portion 38 split along the slit 34 in a vertical plane perpendicular to the center axis of the crankshaft 16. Each of the first and second half portions 36, 38 is integrally molded from die-casting aluminum alloy. Splitting the inner wall 20 and the outer wall 24 in such a way facilitates formation of the slit 34 in the molding process. The first and second half portions 36, 38 are connected to each other by bolts 40.

The engine 2 of the embodiment functions as follows. The piston 12 vertically reciprocates in the cylinder 6 to cause the big end 52 of the connecting rod 14 to swing as shown by the phantom lines in FIG. 3 whereby the crankshaft 16 is rotated. By the motion of the connecting rod 14, the oil dipper 32 provided at the big end 52 thereof goes through the slit 34 projecting into the oil pan 28 or is retracted to the crankcase 22. The tip portion 66 of the oil dipper 32 makes contact with the oil 26 in the oil pan 28 and the oil 26 is splattered or splashed toward the cylinder 6 area to lubricate the parts of the engine 2.

Figure 3:
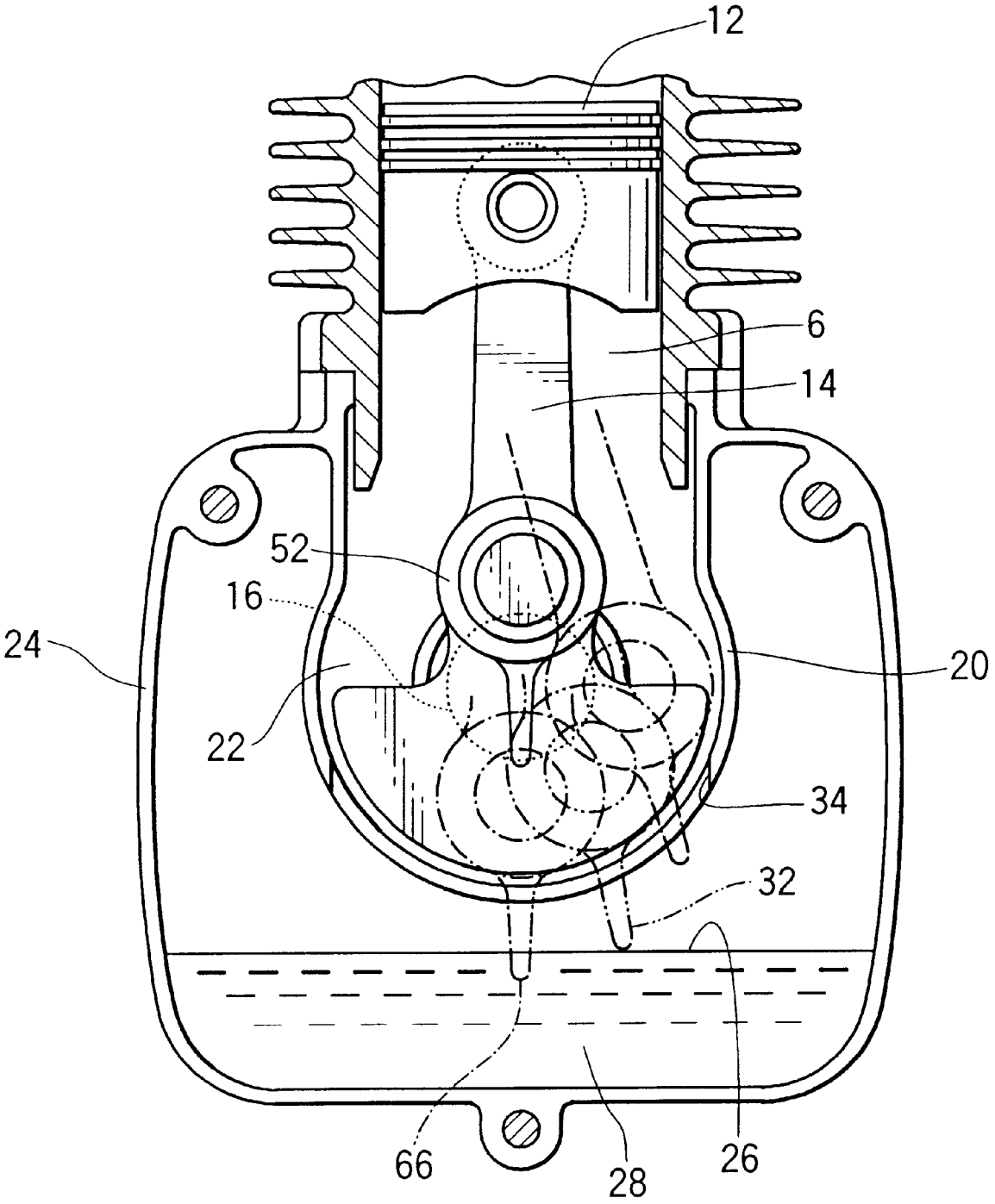
FIG. 3 is a schematic cross-section view of the four-stroke cycle internal combustion engine in accordance with the preferred embodiment showing the function thereof.
Figure 4:
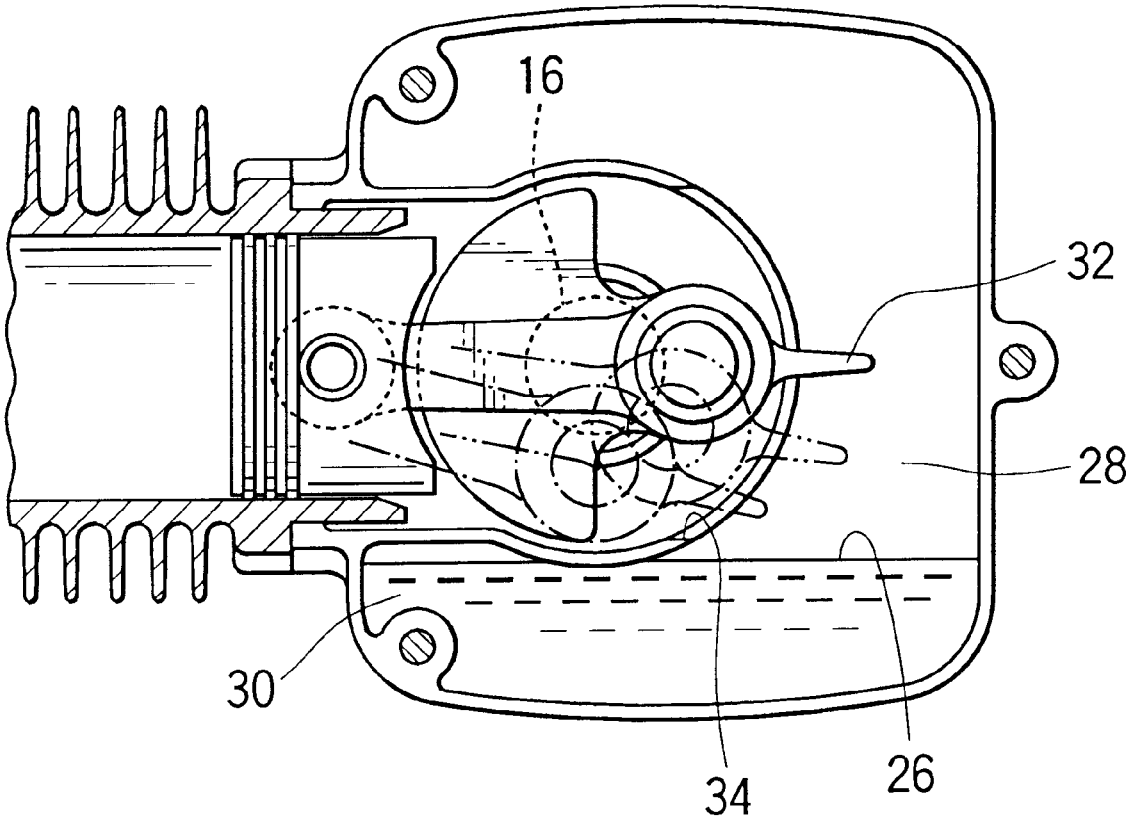
FIG. 4 shows an orientation where the four-stroke cycle internal combustion engine is inclined about an axis of the crankshaft.
Figure 5:
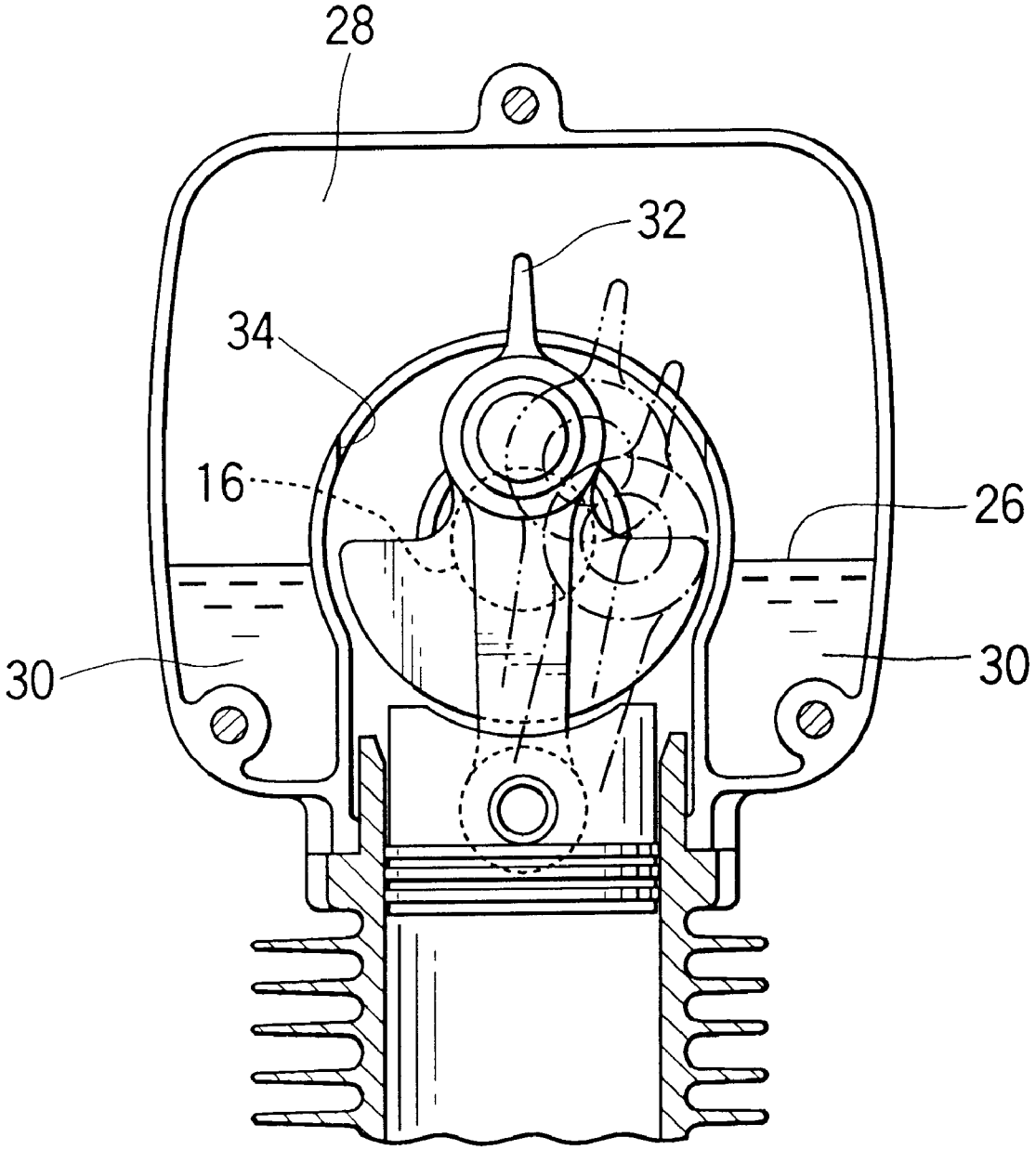
FIG. 5 shows an upside-down orientation of the four-stroke cycle internal combustion engine.

In the case of a trimmer, where an operator cuts weeds on the ground, the engine 2 assumes a vertical orientation as shown in FIG. 3. However, in the situation where the operator trims leaves of trees above the ground or overhead, the engine 2 is inclined to a horizontal (see FIG. 4) or an upside-down orientation (see FIG. 5). In such cases, the oil 26 in the oil pan 28 flows into the oil recess area 30 on both sides of the crankcase 22. The volume of each oil recess area 30 is large enough to contain all of the oil 26 in the oil pan 28 so that the oil 26 in the oil pan 28 does not flow into the crankcase 22 even if the engine 2 is inclined. It is to be noted that when the engine 2 is in a horizontal or upside-down orientation shown in FIG. 4 or 5, the engine parts are not lubricated by the oil since the oil dipper 32 does not come into contact with the oil 26. However, since the engine 2 is not maintained in this orientation for a long time in normal use, it should not create any problem regarding the function of the engine 2.

Furthermore, in the case where the engine 2 is inclined about a lateral axis, i.e. an axis perpendicular to the crankshaft 16, part of the oil 26 in the oil pan 28 flows into the recess areas 30, 30 as shown by the dotted line in FIG. 2. Therefore, it prevents the oil 26 from flowing into the crankcase 22.

According to the engine 2, since the recess areas 30, 30 are provided on the left and right slides of the crankcase 22, as oriented in FIG. 1, the oil 26 does not flow into the crankcase 22 even if the engine 2 is inclined to a horizontal or upside-down orientation. It prevents the piston 12 from being submerged in oil 26 and a breather (not shown) from being blocked thereby.

Further, according to the engine 2, the oil 26 that is heated due to agitation by the oil dipper 32 can be effectively cooled by a two-wall structure consisting of the inner wall 20 and the outer wall 24 because of increased surface area.

Furthermore, the two-wall structure of the inner wall 20 and the outer wall 24 serves to decrease noise from the crankcase 22.

With reference to the engine 2, since the inner wall 20 and the outer wall 24 comprise the first and second half portion 36 and 38, the inner wall 20, the outer wall 24, and the slit 34 can be easily formed by an integral molding process.

The present invention has thus been shown the described with reference to specific embodiments. However, it should be noted that the present invention is no way limited to the details of the described arrangements but changes and modifications may be made without departing from the scope of the appended claims.

For example, in the above embodiment, the oil recess areas 30, 30 are provided on the right and left sides of the crankcase 22. However, the oil recess areas 30, 30 may be provided also at a location rearward of the crankcase 22 opposite from the driving shaft 18.

Furthermore, the inner wall 20 is disposed so as to form the recess areas 30, 30 on the left and right sides of the crankcase 22. However, in some types of the working machines, the engine 2 may only be slightly inclined to the left, right, forward and rearward. In such a case, the recess areas 30, 30 do not need to be extended to the left and right sides of the crankcase 22. The shape and the volume of the recess areas 30, 30 can be determined based on the type of working machines and the orientation of the engine which it assumes during the operation.

Finally, the oil dipper 32 of the embodiment extends from the connecting rod 14 straight along the elongated axis thereof. However, the oil dipper 32 may be formed in a hook shape so that it can splatter or splash more oil.

In the above embodiment, the engine 2 utilized for the trimmer has been explained only as an example of a working machine. The engine 2 of the embodiment can be utilized for any other portable and non-portable working machines which assume an inclined, horizontal or upside-down orientation.

Accordingly, the present invention provides a four-stroke cycle internal combustion engine that can be used for a working machine which may assume an inclined, horizontal or upside-down orientation during operation.

What is claimed is:

1. A four-stroke cycle internal combustion engine, comprising:

a crankcase;

a connecting rod provided in said crankcase, said connecting rod having first and second sides, a bottom, and a big end;

an inner wall extending to surround said sides and said bottom of said connecting rod;

an outer wall extending to surround said inner wall and having upper ends thereof being connected to said inner wall to form an oil reservoir under said crankcase and oil recess areas on both sides of said crankcase therebetween;

an oil dipper, for splattering the oil contained in said oil reservoir, and provided at said big end of said connecting rod; and a slit formed at a bottom of said inner wall for allowing said oil dipper to go through to make a contact with said oil.

2. A four-stroke cycle internal combustion engine in accordance with claim 1, wherein:

the volume of each of said oil recess areas is of a size capable of containing the oil without the oil flowing into said crankcase through said slit when said engine is inclined from a vertical orientation toward an upside-down orientation.

3. A four-stroke cycle internal combustion engine in accordance with claim 1, wherein:

said oil dipper extends substantially straight along a center axis of said connecting rod; and said slit is formed substantially symmetrically with respect to said center axis of said connecting rod.

4. A four-stroke cycle internal combustion engine in accordance with claim 2, wherein:

said oil dipper extends substantially straight along a center axis of said connecting rod, and said slit is formed substantially symmetrically with respect to said center axis of said connecting rod.

* * * * *